US010626698B2

(12) United States Patent
Al-Mousa et al.

(10) Patent No.: US 10,626,698 B2
(45) Date of Patent: Apr. 21, 2020

(54) CEMENT SQUEEZE WELL TOOL

(71) Applicant: Saudi Arabian Oil Company, Dhahran (SA)

(72) Inventors: Ahmed Al-Mousa, Dhahran (SA); Ahmed A. Al-Ramadhan, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 65 days.

(21) Appl. No.: 15/994,580

(22) Filed: May 31, 2018

(65) Prior Publication Data

US 2019/0368292 A1 Dec. 5, 2019

(51) Int. Cl.

| | |
|---|---|
| ***E21B 33/134*** | (2006.01) |
| ***E21B 23/06*** | (2006.01) |
| ***E21B 34/12*** | (2006.01) |
| ***E21B 33/128*** | (2006.01) |
| ***E21B 43/112*** | (2006.01) |
| ***E21B 33/13*** | (2006.01) |
| *E21B 23/00* | (2006.01) |

(52) U.S. Cl.

CPC ..... *E21B 33/134* (2013.01); *E21B 23/06* (2013.01); *E21B 33/128* (2013.01); *E21B 33/13* (2013.01); *E21B 34/12* (2013.01); *E21B 43/112* (2013.01); *E21B 2023/008* (2013.01)

(58) Field of Classification Search

CPC ..... E21B 33/13; E21B 33/134

See application file for complete search history.

(56) References Cited

U.S. PATENT DOCUMENTS

| | | | |
|---|---|---|---|
| 2,121,051 | A | 6/1938 | Ragan et al. |
| 2,316,402 | A | 4/1943 | Canon |
| 2,411,260 | A | 11/1946 | Glover et al. |
| 2,546,978 | A | 4/1951 | Collins et al. |
| 2,672,199 | A | 3/1954 | McKenna |
| 2,707,998 | A | 5/1955 | Baker et al. |
| 2,912,053 | A | 11/1959 | Bruekelman |
| 5,358,048 | A | 10/1994 | Brooks |
| 5,507,346 | A | 4/1996 | Gano et al. |
| 5,842,518 | A | 12/1998 | Soybel et al. |

(Continued)

FOREIGN PATENT DOCUMENTS

| | | |
|---|---|---|
| GB | 2392183 | 2/2004 |
| WO | 2002090711 | 11/2002 |

OTHER PUBLICATIONS

PCT International Search Report and Written Opinion in International Appln. No. PCT/US2019/032467, dated Aug. 8, 2018, 13 pages.

(Continued)

*Primary Examiner* — Kristyn A Hall

(74) *Attorney, Agent, or Firm* — Fish & Richardson P.C.

(57) ABSTRACT

A well tool for cementing a portion of a well includes a cement retainer assembly and a capsule connected to the cement retainer assembly. The cement retainer assembly is configured to be disposed within a wellbore, and includes a ported sub and a cement retainer. The ported sub includes a port to flow cement out of the cement retainer assembly and into an annulus of the wellbore. The capsule includes a body defining an interior chamber of the capsule, where the interior chamber is configured to retain a fluid, and the capsule is configured to be disposed at a location within the wellbore and downhole of the cement retainer assembly.

22 Claims, 4 Drawing Sheets

(56) References Cited

U.S. PATENT DOCUMENTS

| | | | |
|---|---|---|---|
| 7,049,272 | B2 | 5/2006 | Sinclair et al. |
| 7,231,975 | B2 | 6/2007 | Lavaure et al. |
| 2013/0240207 | A1 | 9/2013 | Frazier |
| 2018/0245427 | A1 | 8/2018 | Jimenez et al. |

OTHER PUBLICATIONS

Tam International Inflatable and Swellable Packers, "TAM Scab Liner brochure," Tam International, available on or before Nov. 15, 2016, 4 pages.

CEMENT SQUEEZE WELL TOOL

TECHNICAL FIELD

This disclosure relates to well tools for cementing a portion of a wellbore, for example, in a cement squeeze operation.

BACKGROUND

Some wells undergo cement squeeze operations to repair, solidify, or generally re-cement a portion of a wellbore or casing. A cement squeeze well tool operates to supply cement to an annulus of a wellbore or casing at a location within a wellbore near a perforation, leak, or other unwanted opening in a wall of a wellbore or casing. For example, cement squeeze well tools are utilized when a cemented casing is perforated, faulty, incomplete, or otherwise unsatisfactory and requires additional cement to repair the cemented casing. Sometimes, a cement squeeze well tool disposed in a well includes a packer element and cementing ports to flow cement into an annulus of the wellbore or casing. The cement squeeze well tool can be left in the wellbore to be drilled out at a later time.

SUMMARY

This disclosure describes well tools, such as cement squeeze well tools, for cementing a portion of a well.

In some aspects of the disclosure, a well tool for cementing a portion of a well includes a cement retainer assembly configured to be disposed within a wellbore, the cement retainer assembly including a ported sub, and the ported sub including a port to flow cement out of the cement retainer assembly and into an annulus of the wellbore. The well tool further includes a capsule connected to the cement retainer assembly and including a body defining an interior chamber of the capsule, the interior chamber configured to retain a fluid, and the capsule configured to be disposed at a location within the wellbore and downhole of the cement retainer assembly.

This, and other aspects, can include one or more of the following features. The body of the capsule can include fiberglass. The capsule can include centralizers extending radially outwardly from the body, the centralizers to position the capsule proximate to a radial center of the wellbore. The capsule can include a first connection structure at a first longitudinal end of the capsule and a second connection structure at a second longitudinal end of the capsule opposite the first longitudinal end. The first connection structure can include a threaded pin-type connection or a threaded box-type connection, and the second connection structure can include a threaded pin-type connection or a threaded box-type connection. The first connection structure can directly couple the capsule to the cement retainer assembly. The first connection structure can directly couple the capsule to the ported sub of the cement retainer assembly. The second connection structure can directly couple to a second capsule configured to be disposed at a location within the wellbore and downhole of the first-mentioned capsule, and the second capsule can include a second body defining a second interior chamber of the second capsule. The capsule can include a one-way check valve at a first longitudinal end of the capsule, the one-way check valve configured to allow fluid to enter the interior chamber of the capsule. The one-way check valve can include a spring-loaded check valve. The capsule can include a vent structure at a second longitudinal end of the capsule opposite the first longitudinal end, the vent structure configured to expel gaseous fluid from within the interior chamber out of the interior chamber of the capsule. The vent structure can include a ball member and a ball seat, the ball member having a specific density less than the fluid in the interior chamber. The vent structure can include a one-way check valve. The body can be substantially cylindrical, and an outer diameter of the cylindrical body of the capsule can be between 65 percent and 80 percent of an inner diameter of an inner wall of the wellbore. The cement retainer assembly can include a packer element to seal against an inner wall of the wellbore. The wellbore can be a cased wellbore, and the inner wall of the wellbore can include an inner wall of a casing. The ported sub can include a plurality of ports to flow cement out of the cement retainer assembly, where the plurality of ports includes the port of the ported sub.

Certain aspects of the disclosure encompass a method for cementing a portion of a well. The method includes running a well tool into a wellbore, where the well tool includes a cement retainer assembly including a ported sub, the ported sub including a port, and a capsule connected to the cement retainer assembly and including a body defining an interior chamber of the capsule, the capsule being disposed downhole of the cement retainer assembly. The method further includes receiving well fluid disposed in the wellbore into the interior chamber of the capsule to fill the interior chamber with the well fluid, and flowing cement through the port of the ported sub out of the cement retainer assembly and into an annulus between the capsule and an inner wall of the wellbore.

This, and other aspects, can include one or more of the following features. The cement retainer assembly can include a packer element to seal against an inner wall of the wellbore, and the method can include, prior to flowing cement through the port of the ported sub, engaging the inner wall of the wellbore with the packer element to isolate the wellbore downhole of the packer element. The method can further include positioning the packer element of the cement retainer assembly uphole of a perforation in the inner wall of the wellbore. Receiving well fluid into the interior chamber of the capsule can include flowing well fluid through a one-way check valve at a first longitudinal end of the capsule to fill the interior chamber of the capsule with the well fluid. Receiving well fluid through a one-way check valve at a first longitudinal end of the capsule can include expelling gaseous fluid from within the interior chamber out of the interior chamber through a vent structure at a second longitudinal end of the capsule opposite the first longitudinal end. The wellbore can be a cased wellbore, the inner wall of the wellbore can include an inner wall of a casing, and flowing cement into the annulus between the capsule and the inner wall of the wellbore can include flowing the cement into the annulus between the capsule and the inner wall of the casing.

Certain aspects of the disclosure include a capsule for a cement squeeze well tool. The capsule includes a body defining an interior chamber configured to retain a fluid, a connection structure at a first longitudinal end of the substantially cylindrical body, the connection structure configured to couple to a cement squeeze well tool, and a one-way check valve at a second longitudinal end of the substantially cylindrical body opposite the first longitudinal end and fluidly connected to the interior chamber. The one-way check valve is configured to flow fluid into the interior chamber.

This, and other aspects, can include one or more of the following features. The capsule can include a vent structure at the second longitudinal end of the body and fluidly connected to the interior chamber, the vent structure to expel gaseous fluid out of the interior chamber. The connection structure can include a threaded pin-type connection or a threaded box-type connection. The body can be substantially cylindrical.

The details of one or more implementations of the subject matter described in this disclosure are set forth in the accompanying drawings and the description. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
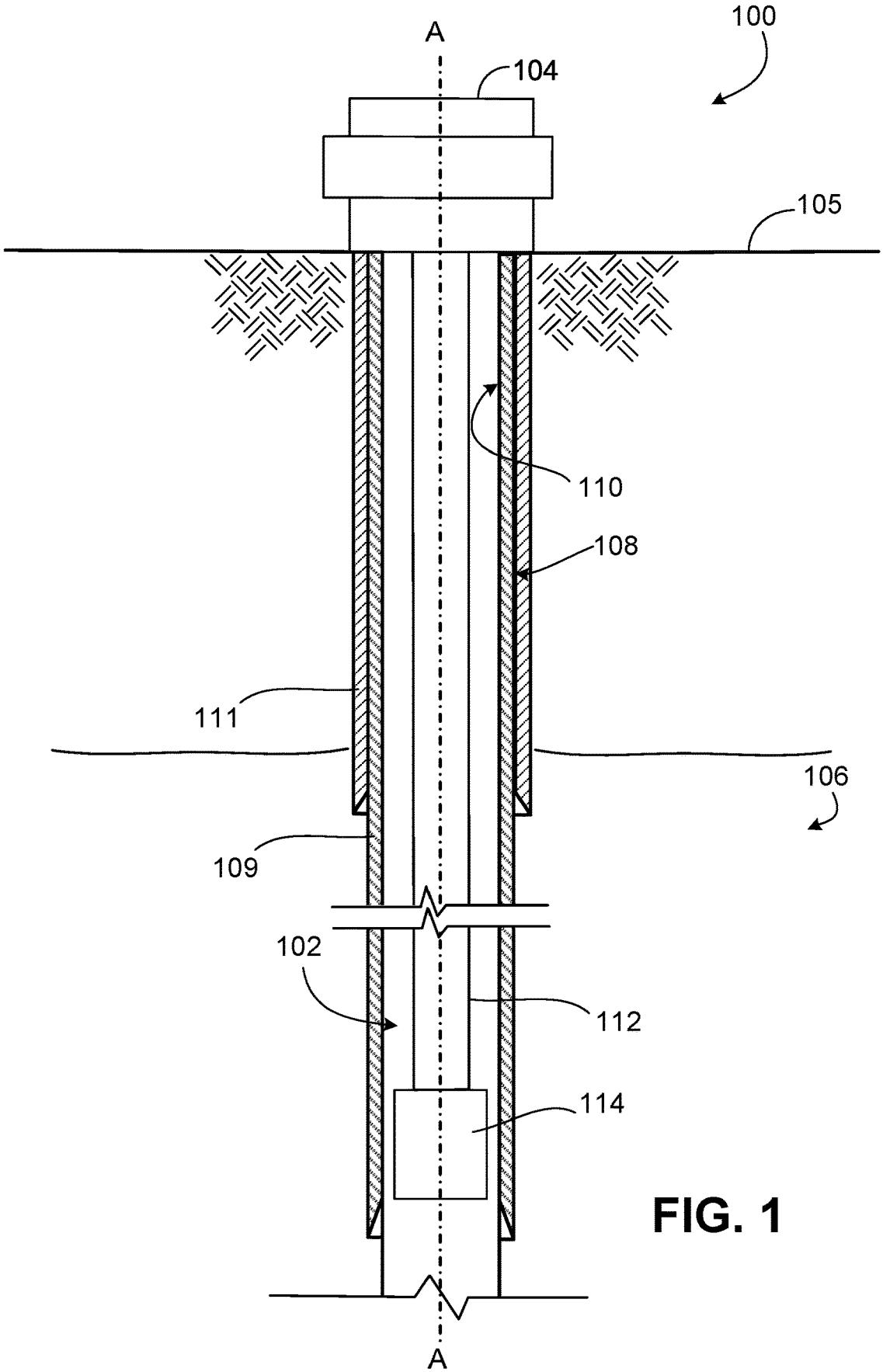
FIG. 1 is a schematic partial cross-sectional side view of an example well system with an example cementing well tool.

This disclosure describes a well tool for cementing a portion of a well, such as for a cement squeeze operation. The cement squeeze well tool described here includes a capsule that can be disposed in a wellbore to reduce a cement volume required to fill a portion of the wellbore with cement. The cement squeeze well tool can be utilized in a cased wellbore, such as adjacent to a casing of a wellbore, or in an uncased, open hole portion of the wellbore. The well tool can include one or more of the capsules positioned downhole of a cement retainer or other fluid injection tool. In some implementations, the well tool is positioned adjacent to wellbore perforations, casing perforations, a casing leak, or another fluid loss opening in the wellbore. The capsules can be made of fiberglass, high strength plastic, aluminum, a combination of these materials, or another material that can be drilled through, such as with a drilling bit or mill, following the cement squeeze operation. Generally, the material of the capsule is softer than steel, for example, so that the capsule can be drilled through. The shape of a portion of the capsule can include a generally cylindrical shape with an outer diameter that approaches, but is less than, the inner diameter of the inner wall of the wellbore, such as an inner wall diameter of the casing or open hole portion of the wellbore.

The capsule(s) occupies a volume within the wellbore or casing, thereby decreasing the internal volume in the wellbore available to flow cement. In other words, the capsule(s) decreases a volume of the annulus between the capsule and the inner wall of the wellbore adjacent the capsule such that a cementing operation to fill the annular space between the capsule and the inner wall of the wellbore requires less cement, for example, as compared to a well tool without a capsule or a well tool with a certain well string having a smaller diameter than the capsule. The capsule can connect to a cement retainer via a ported sub, which allows cement to flow through the cement retainer out of the ported sub and around the capsule. The capsule can also include a valve assembly including a check valve and a vent structure, such that as the cement retainer and the capsule are lowered downhole, fluids in the casing enter into the capsule through the check valve, and gaseous fluid is expelled from the capsule through the vent structure. In some implementations, multiple capsules can be connected end-to-end, for example, by threaded pin-and-box connections.

In certain cement squeeze assemblies, a cement retainer is lowered downhole into a cased portion of a wellbore. In these cement squeeze operations, the cement retainer requires the wellbore downhole of the cement retainer to be empty of other tools, such that the wellbore is completely filled with cement in order to squeeze some cement into a perforation or other leak in the casing. In the present disclosure, one or more capsules can attach to a downhole end of the cement retainer and occupy a volume in the wellbore, thereby reducing the amount of cement required in a cement squeeze operation. The cement squeeze operation addresses a loss circulation zone, for example, by plugging a casing leak, casing perforation, wellbore wall perforation, or other fluid loss opening in the wellbore with cement.

In some instances, a string of capsules can connect to the cement retainer and be long enough to partially or entirely cover an open hole section of the wellbore below a casing shoe to the loss circulation zone with the cement retainer set inside the casing. This assembly can allow for addressing a loss circulation zone that is far away from a downhole end of a casing, defined by a casing shoe, where the capsule string is drilled through with a drill string after a cementing operation. The drill string can regain the length previously drilled prior to the cement squeeze operation without the need for a directional bottom hole assembly (BHA), for example, because the drill string can chase the previous wellbore direction by drilling through and following the capsule(s), as opposed to drilling through only cement. In this instance, the capsule or capsules act as a directional guide for a drill bit of a drill string to follow after a cement squeeze operation. The well tools described here utilizing one or more capsules reduce an amount of cement required for a cementing operation, and provide for a faster and more economical cementing operation, for example, compared to completely filling a wellbore with cement without the use of capsules.

FIG. 1 is a schematic partial cross-sectional side view of an example well system 100 that includes a substantially cylindrical wellbore 102 extending from a wellhead 104 at a surface 105 downward into the Earth into one or more subterranean zones of interest. The example well system 100 shows one subterranean zone 106; however, the example well system 100 can include more than one zone. The well system 100 includes a vertical well, with the wellbore 102 extending substantially vertically from the surface 105 to the subterranean zone 106. The concepts described here, however, are applicable to many different configurations of wells, including vertical, horizontal, slanted, or otherwise deviated wells.

After some or all of the wellbore 102 is drilled, a portion of the wellbore 102 extending from the wellhead 104 to the subterranean zone 106 can be lined with lengths of tubing, called casing or liner. The wellbore 102 can be drilled in stages, the casing may be installed between stages, and cementing operations can be performed to inject cement in stages between the casing and a cylindrical wall positioned radially outward from the casing. The cylindrical wall can be an inner wall of the wellbore 102 such that the cement is disposed between the casing and the wellbore wall, the cylindrical wall can be a second casing such that the cement is disposed between the two tubular casings, or the cylindrical wall can be a different substantially tubular or cylindrical surface radially outward of the casing. In the example well system 100 of FIG. 1, the system 100 includes a first liner or first casing 108, such as a surface casing, defined by lengths of tubing lining a first portion of the wellbore 102 extending from the surface 105 into the Earth. The first casing 108 is shown as extending only partially down the wellbore 102 and into the subterranean zone 106; however, the first casing 108 can extend further into the wellbore 102 or end further uphole in the wellbore 102 than what is shown schematically in FIG. 1. A first annulus 109, radially outward of the first casing 108 between the first casing 108 and an inner wall of the wellbore 102, is shown as filled with cement. The example well system 100 also includes a second liner or second casing 110 positioned radially inward from the first casing 108 and defined by lengths of tubing lining a second portion of the wellbore 102 that extends further downhole of the wellbore 102 than the first casing 108. The second casing 110 is shown as extending only partially down the wellbore 102 and into the subterranean zone 106, with a remainder of the wellbore 102 shown as open-hole (for example, without a liner or casing); however, the second casing 110 can extend further into the wellbore 102 or end further uphole in the wellbore 102 than what is shown schematically in FIG. 1. A second annulus 111, radially outward of the second casing 110 and between the first casing 108 and the second casing 110, is shown as filled with cement. The second annulus 111 can be filled partly or completely with cement. In some instances, this second annulus 111 is a casing-casing annulus (CCA), for example, because it is an annulus between two tubular casings in a wellbore. While FIG. 1 shows the example well system 100 as including two casings (first casing 108 and second casing 110), the well system 100 can include more casings or fewer casings, such as one, three, four, or more casings. In some examples, the well system 100 excludes casings, and the wellbore 102 is at least partially or entirely open bore.

The wellhead 104 defines an attachment point for other equipment of the well system 100 to attach to the well 102. For example, the wellhead 104 can include a Christmas tree structure including valves used to regulate flow into or out of the wellbore 102, or other structures incorporated in the wellhead 104. In the example well system 100 of FIG. 1, a well string 112 is shown as having been lowered from the wellhead 104 at the surface 105 into the wellbore 102. In some instances, the well string 112 is a series of jointed lengths of tubing coupled end-to-end or a continuous (or, not jointed) coiled tubing. The well string 112 can make up a work string, testing string, production string, drill string, or other well string used during the lifetime of the well system 100.

The well string 112 can include a number of different well tools that can drill, test, produce, intervene, or otherwise engage the wellbore 102. In the example well system 100 of FIG. 1, the well string 112 includes a well tool 114 for cementing a portion of the wellbore 102, where the well tool 114 is located at a bottommost, downhole end of the well string 112. The well tool 114 can include a fluid retainer tool, such as a cement retainer, and one or more capsules connected to the fluid retainer tool for cementing a portion of the wellbore 102. The example well tool 114 can perform a cement squeeze operation, for example, to plug a fluid loss opening in the wall of the wellbore 102, such as the inner wall of a casing or inner wall of the open hole formation of the wellbore 102. The fluid loss opening can include cracks, fractures, perforations, or other openings in the first casing 108, second casing 110, both casings 108 and 110, the wellbore wall of the open hole portion, or another location along the inner wall of the wellbore 102 that allows unwanted fluid flow or leaks. The well tool 114 provides cement to the wellbore 102 downhole of the cement retainer to plug the fluid loss opening, and the capsule or capsules occupy a volume downhole of the cement retainer that reduces the amount of cement needed to fill the wellbore 102 downhole of the cement retainer and plug the fluid loss opening.

Figure 2:
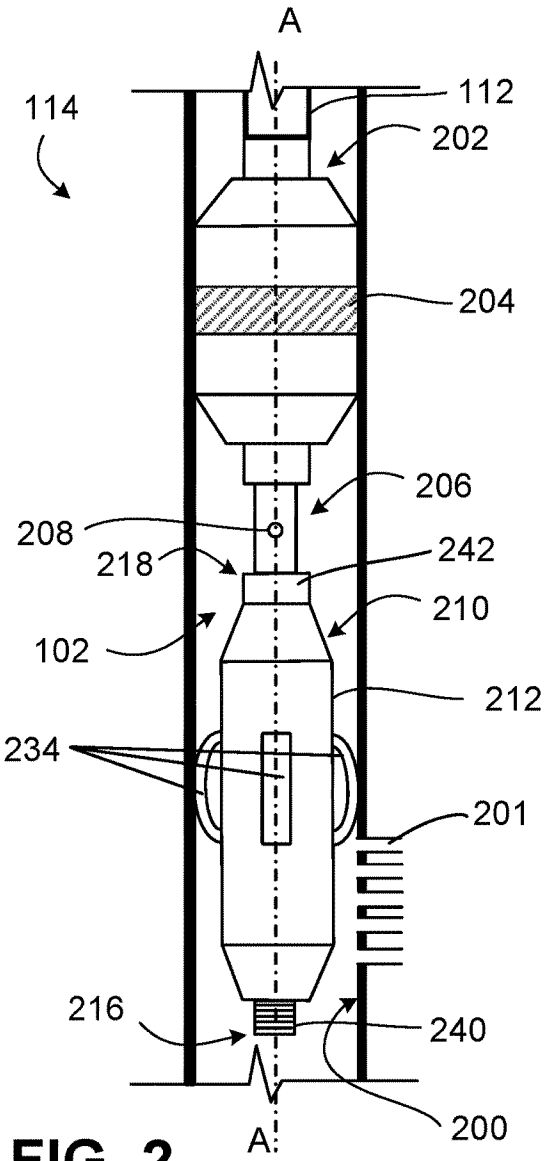
FIG. 2 is a schematic side view of an example cementing well tool disposed in a wellbore.

FIG. 2 is a schematic side view of the example well tool 114, which can be used in the well system 100 of FIG. 1. The well tool 114 is disposed in the wellbore 102 adjacent to an inner wall 200 of the wellbore 102. In FIG. 2, the inner wall 200 of the wellbore is the inner wall 200 of the casing 110 of FIG. 1, such that the well tool 114 is disposed adjacent to the casing 110 in the wellbore 102. In some implementations, the well tool 114 can be disposed in an open hole portion of the wellbore 102, for example, such that the inner wall of the wellbore is the inner wall of the formation in the open hole portion of the wellbore 102. The inner wall 200 includes a fluid loss opening 201, such as a perforation, leak, or other opening in the inner wall 200 that allows unwanted fluid flow.

The well tool 114 includes a cement retainer 202, a ported sub 206 having one or more ports 208 (one shown), and a capsule 210 disposed downhole of the cement retainer 202. The capsule 210, ported sub 206, and cement retainer 202 are connected to each other at the surface of the well (for example, at the rig floor) before the well tool 114 is deployed, or lowered, into the wellbore 102. The well tool 114 acts to receive a flow of cement from an uphole location, for example, via a work string connected to the well tool 114, and to direct the cement into the wellbore 102 downhole of the cement retainer 202. The cement retainer 202 is shown in FIG. 2 as including a packer element 204 circumscribing a body of the cement retainer 202, where the packer element 204 is configured to radially expand and engage with the inner wall 200 of the wellbore 102. While FIG. 2 shows one port 208 in the ported sub 206, the sub 206 can include additional ports 208 distributed evenly or unevenly about the sub 206. For example, the ported sub 206 can include two, three, or four ports 208 distributed radially about the ported sub 206, for example, for even distribution of cement out of the ports 208. During a cement squeeze operation, the well tool 114 is lowered into the wellbore 102, the packer 204 engages the inner wall 200 and sets the cement retainer 202 in place in the wellbore 102, cement is pumped through the cement retainer 202 and out of the port 208 of the ported sub 206, and the cement flows through the annular space between the capsule 210 and the inner wall 200. The well tool 114 can be positioned such that the packer 204 is set just uphole of the fluid loss opening 201, for example, such that the capsule 210 is directly adjacent to or close to (for example, within ten linear feet of) the fluid loss opening 201. The cement fills the open volume of the wellbore 102 downhole of the packer 204, and can plug perforations, leaks, or other fluid loss openings in the inner wall 200 of the wellbore 102 or casing 110, such as fluid loss opening 201, as the cement sets.

Figure 3:
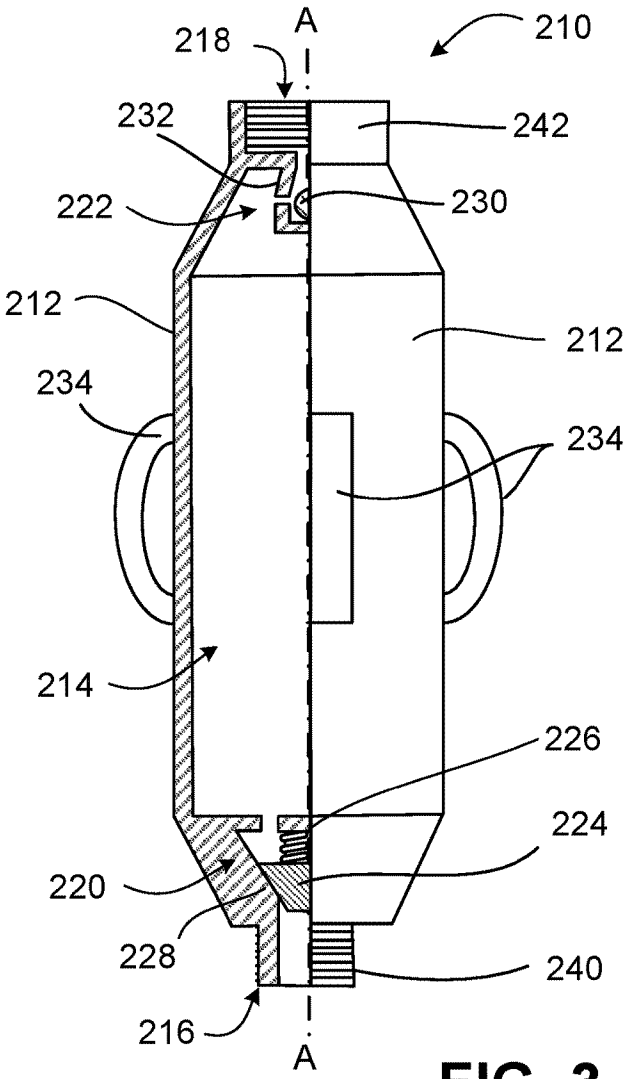
FIG. 3 is a schematic partial cross-sectional side view of an example capsule of an example cementing well tool.

The capsule 210 occupies a volume of space downhole of the cement retainer 202 to reduce a volume of cement used to fill the wellbore 102, for example, during a cement squeeze operation or other cementing operation. FIG. 3 is a schematic partial cross-sectional side view of the example capsule 210, which is part of the example well tool 114 of FIG. 2. Referring to both FIGS. 2 and 3, the capsule 210 includes a body 212 having a substantially cylindrical shape. The body 212 is substantially hollow and defines an interior chamber 214 configured to retain a fluid. In some instances, the capsule body 212 need not be cylindrical throughout its entire axial length. For example, as shown in FIGS. 2 and 3, the generally cylindrical body 212 of the example capsule 210 includes chamfered ends at the longitudinal ends of the body 212. These chamfered ends can lessen turbulence experienced by the capsule 210 as it is lowered downhole in the wellbore 102 through wellbore fluid. In some examples, an outer surface of the body 212 that is exposed to fluid in the wellbore 102 can include divots, dents (such as on a golf ball), bumps, or other surface structures, or the body 212 can include a cone-shaped profile at a downhole end of the capsule 210, for example, to aid in the lowering of the capsule 210 downhole through the wellbore 102. In some examples, the surface of the body 212 can include patterns of grooves to enhance the engagement between the capsule body and the cement, and to prevent or reduce unwanted rotation of the body 212 during a drill-out process.

The size of the capsule 210 can vary. For example, a longitudinal length of the capsule 210 can range from 10 feet to 40 feet, such as a 30 foot length, and an outer diameter of the capsule 210 can range from 3 inches to 16 inches, for example, depending on the size of the wellbore 102. In some implementations, the body 212 has an outer diameter that approaches but is less than the inner diameter of the inner wall 200. For example, the body 212 can have an outer diameter that is between 65 percent and 80 percent of the diameter of the inner wall 200, such as 75 percent of the diameter of the inner wall 200. In some examples, the outer diameter of the body 212 is greater than an outer diameter of the well string supporting the well tool 114 in the wellbore 102.

The body 212 of the capsule 210 includes a valve system that allows for the flow of fluid through the interior chamber 214 in a selective manner. For example, the example capsule 210 is shown in FIG. 3 as including a one-way check valve 220 at a first longitudinal end 216 of the body 212 of the capsule 210 and a vent structure 222 at a second longitudinal end 218 of the body 212 opposite the first longitudinal end 216. The first longitudinal end 216 is shown in FIG. 3 as a downhole end of the body 212 and the second longitudinal end 218 is shown as an uphole end of the body 212, for example, with respect to longitudinal axis A-A of the wellbore 102. The one-way check valve 220 allows fluid to enter into the interior chamber 214 of the capsule 210. For example, the one-way check valve 220 allows well fluid in the wellbore 102 to enter into the interior chamber 214 while the well tool 114 is lowered downhole in the wellbore 102. The vent structure 222 allows for venting of trapped air, gaseous fluid, or other fluid within the interior chamber 214 out of the interior chamber 214, for example, as the interior chamber 214 fills with well fluid entering through the one-way check valve 220. With the valve system, the capsule 210 is self-filling, in that the interior chamber 214 can fill with fluid residing in the wellbore 102 as the capsule 210 is lowered downhole prior to a cementing operation. In some implementations, the interior chamber 214 is pre-filled with a fluid (for example, brine, water, or other fluid) prior to lowering the capsule 210 into the wellbore 102. In certain implementations, the capsule 210 excludes the valve system, and can be pre-filled with a fluid, as described earlier.

The one-way check valve 220 of the valve system can take a variety of different forms. For example, the one-way check valve 220 can include a ball check valve, diaphragm check valve, tilting disc check valve, a lift-check valve, a combination of these, or another type of one-way check valve. In the example capsule 210 of FIG. 3, the one-way check valve 220 is a spring-loaded cone check valve that allows fluid flow into the interior chamber 214, but prevents flow out of the interior chamber 214 through the check valve 220. For example, the one-way check valve 220 includes a plug element 224 in the shape of a truncated cone and biased by a spring 226 in a direction (for example, the downhole direction) toward a plug seat 228 formed in the body 212 of the capsule 210 proximate to the first longitudinal end 216. The plug seat 228 is shaped to receive and engage with the plug element 224 such that the plug element 224 seals against the plug seat 228 when the plug element 224 is seated in the plug seat 228. The spring-loaded plug element 224 acts as a one-way valve such that a force applied to the plug element from within the interior chamber 214 in a downhole direction does not open the one-way check valve 220 because it acts in the same direction as the spring, forcing the plug element 224 into fluid sealing engagement with the plug seat 228. On the other hand, a force acting against the plug element 224 opposite the biasing force of the spring 226 that is greater than the spring bias force applied by the spring 226 opens the one-way check valve 220 to fluid flow into the interior chamber 214. For example, a fluid within the interior chamber 214 cannot exit the chamber 214 through the one-way check valve 220, while fluid exterior to the capsule 210 can enter the chamber 214 through the one-way check valve 220. In some implementations, the check valve can incorporate a weighted plug element without a spring, for example, where the weight of the weighted plug element acts as a biasing force toward the closed position of the check valve. However, weighted plugs may be effective only in a vertical or slightly deviated orientation of the check valve (for example, only in vertical wellbores or slightly deviated wellbores), as an angled orientation of the check valve may affect the effectiveness and direction of the weighted plug element to bias toward and seal against the plug seat.

In some implementations, as the capsule 210 is lowered downhole, fluid residing in the wellbore 102 applies a force on the plug element 224 greater than a minimum threshold force to open the check valve 220. The minimum threshold force to open the check valve 220 is a force equal to or greater than an opposite force applied by the spring 226 (for example, the spring bias of spring 226) on the plug element 224. When the well fluid applies at least the minimum threshold force on the plug element 224, the spring 226 compresses and the check valve 220 allows the well fluid to flow into the interior chamber 214 of the capsule 210. The spring characteristics can vary, for example, based on expected well fluid pressures and well applications. In some examples, the spring 226 has a stiffness that is based on a desired opening force of the check valve 220, based on the area of the face of the plug element 224, the size or volume of the interior chamber 214 of the capsule 210, a combination of these features, or other parameters. Of course, as the interior chamber 214 fills with fluid, the minimum threshold force to open the check valve 220 increases, as the minimum threshold force includes the spring bias combined with an applied force on the plug element 224 in a downhole direction from fluid within the interior chamber 214. In some examples, the check valve 220 has a pressure rating of 100 psi, such that a pressure differential at or greater than 100 psi between pressure in the interior chamber 214 and the pressure exterior to the capsule 210 (such as the hydrostatic pressure of wellbore 102) opens the check valve 220, and a pressure differential less than 100 psi closes the check valve 220. In other words, when the pressure in the wellbore 102 exterior to the capsule 210 is at least 100 psi greater than the pressure within the interior chamber 214 of the capsule 210, the check valve 220 opens.

While the check valve 220 is shown at the first longitudinal end 216 of the capsule 210 and centered along the central longitudinal axis A-A, the position of the check valve and the number of check valves can be different. For example, the capsule 210 can include one, two, or more check valves positioned anywhere along the periphery of the body 212 of the capsule 210. FIG. 3 shows the check valve 220 as positioned at a center of a box-type threaded connection structure of the capsule 210, described in more detail later. However, the check valve 220 can be positioned offset from the center of this connection structure, for example, such that the check valve 220 receives fluid from the wellbore 102 at a location radially outward from the connection structure at the center of the first longitudinal end 216 of the capsule 210. In some examples, the check valve 220 is positioned close to the bottom longitudinal end 216, or within the bottom quarter of the body 212, such that the chamber 214 of the capsule 210 fills from bottom up. In some instances, the check valve 220 is positioned on the chamfered edge of the body 212 at the first longitudinal end 216.

The vent structure 222 of the valve system can also take a variety of different forms. For example, the vent structure 222 can include a vent flap, a ball-and-seat structure, a one-way check valve, a combination of these, or another type of vent structure. In the example capsule 210 of FIG. 3, the vent structure 222 includes a ball member 230 and a corresponding ball seat 232 formed in the body 212 of the capsule 210. The ball seat 232 is shaped to enclose the ball member 230, yet have the ball member 230 free to move between a closed position (where the ball member 230 engages the ball seat 232) and an open position (where the ball member 230 does not sit in the ball seat 232). The ball member 230 can be made of rubber, plastic, or another material. In the example capsule 210 of FIG. 3, the capsule 210 is oriented vertically such that gravity, hydrostatic pressure in the wellbore 102, or both, biases the ball member 230 out of the ball seat 232, thereby keeping the vent structure 222 open to allow venting of air or gaseous fluid out of the interior chamber 214. In some implementations, the ball member 230 has a specific density less than the well fluid (for example, water) such that as the interior chamber 214 fills entirely with well fluid, the well fluid reaches the ball member 230, lifts the ball member 230 into sealing engagement with the ball seat 232, and plugs the vent structure 222 from allowing further flow of fluid out of the interior chamber 214.

In some implementations, as the capsule 210 is lowered downhole and the interior chamber 214 fills with fluid entering through the check valve 220, trapped air or other gaseous fluid residing in the interior chamber 214 is expelled out of the interior chamber 214 through the vent structure 222. As the interior chamber fills completely with the well fluid, the vent structure 222 closes. The specific density of the ball member 230 can vary, for example, based on expected well fluid types and well applications. In some examples, the ball member 230 has a specific density less than or equal to that of the lightest expected wellbore fluid, such as water. For example, the ball member 230 can have a specific gravity of 0.8.

While the vent structure 222 is shown in FIG. 3 at the second longitudinal end 218 of the capsule 210 and centered along the central longitudinal axis A-A, the position of the vent structure and the number of vent structures can be different. For example, the capsule 210 can include one, two, or more vent structures positioned on the capsule 210. The vent structure 222 is shown in FIG. 3 as at the uphole end of the capsule 210, for example, to better vent out air or other lighter fluid or gaseous fluid out of the interior chamber 214 with the capsule oriented vertically. However, in some implementations, such as in a slanted or horizontal wellbore, one or more vent structures can be positioned elsewhere along the periphery of the body 212 of the capsule 210, for example, such that the vent structure is positioned at a vertical top of the capsule 210 when the capsule is set in a slanted, horizontal, or otherwise non-vertical wellbore. FIG. 3 shows the vent structure 222 as positioned at a center of a pin-type threaded connection structure of the capsule 210, described in more detail later. However, the vent structure 222 can be positioned offset from the center of this connection structure, for example, such that the vent structure 222 vents trapped air to the wellbore 102 radially outward from the connection structure at the center of the second longitudinal end 218 of the capsule 210. In some examples, the vent structure 222 is positioned close to the top longitudinal end 218, or within the top quarter of the body 212, such that the trapped air vents from the top of the chamber 214 as it fills with fluid from the bottom of the chamber 214. In some instances, the vent structure 222 is positioned on the chamfered edge of the body 212 at the second longitudinal end 218. Moreover, if a string of multiple capsules 210 are lowered in the wellbore like demonstrated in FIG. 4 (described in more detail later), the ball member 230 can be removed from the capsules downhole of the uphole-most capsule, and kept only in the top, uphole-most capsule to allow continuous venting of all capsules, if the vent structure 222 is positioned in the center of the top end of the uphole-most capsule directly below the threaded box-type connection 242. If the vent structure 222 is positioned elsewhere on the circumference of the body 212 of the capsule 210 by which it is not venting through the threaded box-type connection 242, the ball members can be left in place.

The capsule 210 includes centralizers 234 that extend radially outward from the body 212. In the example capsule 210 of FIGS. 2 and 3, four centralizers 234 evenly spaced about the circumference of the body 212 position the body 212 of the capsule 210 at a radial center of the wellbore 102 or casing 110, for example, centered along longitudinal axis A-A. The centralizers 234 also position the body 212 of the capsule 210 separate from the inner wall 200, for example, to allow for the annulus to form between the body 212 and the inner wall 200. While the example capsule 210 includes four centralizers 234, a different number of centralizers can be used, such as one, two, three, or five or more centralizers 234. The centralizers 234 position the capsule 210 such that cement can flow evenly around the capsule during a cementing operation. For example, without centralizers 234, the body 212 of the capsule may approach or touch the inner wall 200, which may provide insufficient space for cement to flow around the capsule and reach a fluid loss opening in the inner wall 200. FIGS. 2 and 3 show the centralizers 234 as straps having a curved shape and connected at longitudinal ends to the body 212. However, the centralizers can take other forms, such as pegs, studs, or other structures that extend radially from the body 212. The centralizers 234 can be rigid, or can be flexible in a radial direction to allow for variations in the diameter of the inner wall 200 as the capsule 210 moves longitudinally within the wellbore 102. While FIGS. 2 and 3 show the centralizers 234 as distributed evenly in a single row, the capsule 210 can include additional centralizers in one or more additional rows longitudinally above, below, or otherwise positioned on the body 212.

The body 212 of the capsule 210 is made of a material that can be drilled through with a drilling tool in a drilling operation following a cementing operation. For example, the body of the capsule 210 can comprise, or be made of, fiberglass or another drillable material. Fiberglass is lightweight and easily drilled through, for example, as compared to metal and other materials, and fiberglass has sufficient burst and collapse pressure ratings, for example, to survive a wellbore run-in and a cement squeeze operation. The material of the body 212 is rigid enough to connect to the cement retainer 202, ported sub 206, or both, and support the weight and contain the pressures of fluid that resides in the interior chamber 214, while also brittle enough to be drilled through in a subsequent drilling operation following the completion of a cementing operation. Both the check valve 220 and the vent structure 222 of the capsule 210 allow pressure equalization between the interior chamber 214 and the wellbore 102 during high pressure cement squeeze operations to avoid the capsule 210 from collapsing or bursting. In addition, the centralizers 234 promote even distribution of cement during the cement squeeze operation by centering the body 212 of the capsule 210 in the wellbore 102.

The cement retainer 202, the ported sub 206, and the capsule 210 can connect to each other in a variety of ways. For example, one or more of the cement retainer 202, ported sub 206, or capsule 210 can be integrally connected, directly coupled (for example, threaded, welded, or otherwise coupled to each other), indirectly connected (for example, via an intermediate sub or other structure), a combination of these connections, or another type of connection. In the example well tool 114 of FIG. 2, the cement retainer 202 directly connects to the ported sub 206 by a threaded connection, and the capsule 210 directly connects to the ported sub 206 by a threaded connection. In some examples, the ported sub 206 is integrally coupled to the cement retainer 202, in that the ported sub 206 is part of the cement retainer 202. The cement retainer 202 and the ported sub 206 can form a cement retainer assembly, which connects to the capsule 210 at a downhole longitudinal end of the cement retainer assembly, such as at a downhole longitudinal end of the ported sub 206. The cement retainer 202 can connect to a well string, such as the well string 112 of FIG. 1, at an uphole longitudinal end of the cement retainer 202. This connection between the cement retainer 202 and the well string can be a threaded coupling, an integral connection, or another connection type.

The capsule 210 includes a first connection structure at the first longitudinal end 216 of the capsule 210, and includes a second connection structure at the second longitudinal end 218 of the capsule 210. These connection structures allow the capsule 210 to connect to other structures, such as the ported sub 206, the cement retainer 202, another capsule, or a combination of these structures. Referring to FIGS. 2 and 3, the example capsule 210 includes a threaded pin-type connection 240 at the first longitudinal end 216 of the capsule 210, and includes a threaded box-type connection 242 at the second longitudinal end 218 of the capsule 210. The capsule 210 is shown in FIG. 2 as directly coupled to the ported sub 206, for example, such that the threaded box-type connection 242 of the capsule threadingly engages with a corresponding pin-type connection of the ported sub 206. The threaded pin-type connection 240 of the capsule 210 allows for attachment to other tools, such as another capsule. As described earlier though, the particular connection structures on the capsule 210 can vary.

Figure 4:
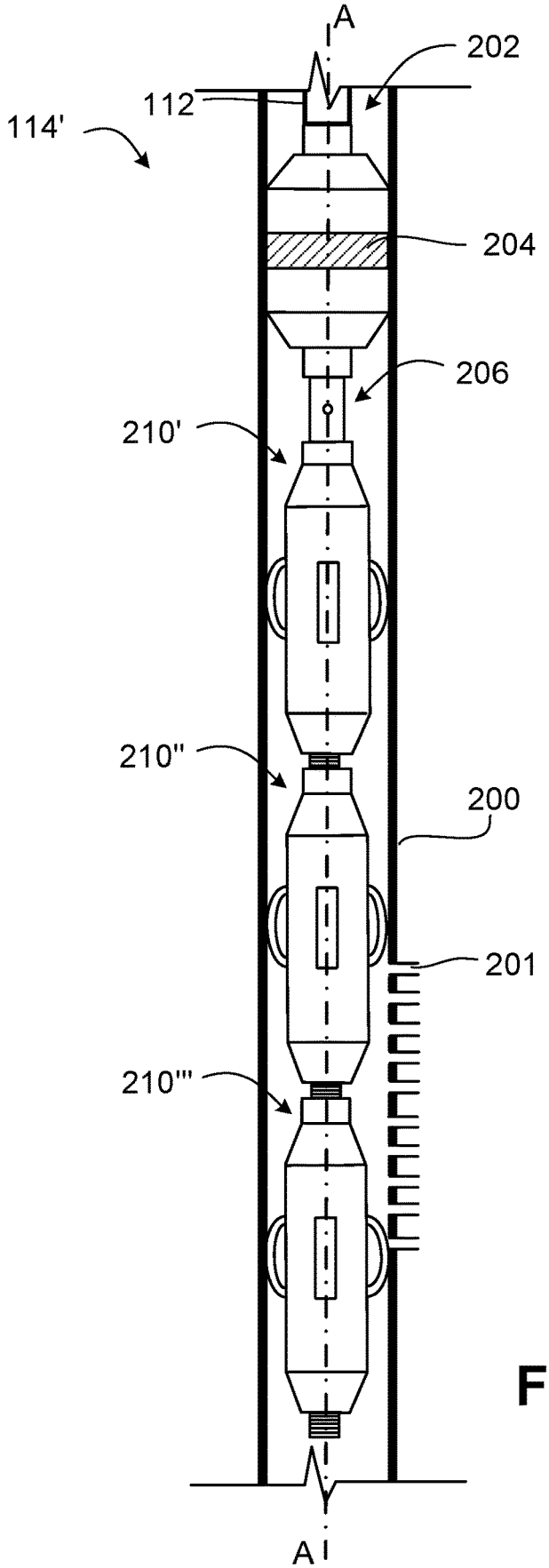
FIG. 4 is a schematic side view of an example cementing well tool disposed in a wellbore.

In some implementations, the well tool 114 can include more than one capsule 210. For example, FIG. 4 is a schematic side view of an example cementing well tool 114' disposed in the wellbore 102. Well tool 114' is similar to the well tool 114 of FIG. 2, except the well tool 114' includes a first capsule 210', a second capsule 210", and a third capsule 210'" connected in series along the longitudinal axis A-A of the wellbore 102. Each of the first capsule 210', second capsule 210", and third capsule 210'" can be similar in structure to the capsule 210 of FIGS. 2-3. While FIG. 4 shows the well tool 114' as having three capsules, the well tool 114' can include less capsules or more capsules.

The first capsule 210', second capsule 210", and third capsule 210'" are connected in series, and connect to each other with threaded connection structures, such as pin-type connections and corresponding box-type connections. Each of the capsules 210', 210", and 210'" have a check valve (like check valve 220 of capsule 210, described earlier) and a vent structure (like vent structure 222 of capsule 210, described earlier), to allow the first capsule 210', second capsule 210", and third capsule 210'" to be filled with well fluid, brine, or other fluid as they are lowered into the wellbore 102, and the vent structures allow for venting of trapped air and gaseous fluid out of the first capsule 210', second capsule 210", and third capsule 210'" to reduce a buoyancy effect of the first capsule 210', second capsule 210", and third capsule 210'" as the well tool 114' is run into the wellbore 102.

In some implementations, for a string of multiple capsules (210', 210" and 210'") that are lowered in the wellbore like demonstrated in FIG. 4, the bottom capsules 210'" and 210" can exclude a ball member, or a vent structure altogether, such that the tops of the capsules 210'" and 210" are fluidly connected to the adjacent capsule connected directly uphole of the respective capsule without interference. A vent structure and respective ball member can be kept in only the top capsule 210' to allow continuous venting of all capsules 210', 210", and 210'", for example, when vent structures or direct fluid pathways are positioned in the center of the top end of the capsules directly below the threaded box-type connection of the respective capsules 210'" and 210". If the vent structure is positioned elsewhere on the circumference the body of capsule 210'", capsule 210", or both capsules 210" and 210'" such that the vent structures do not vent through the threaded box-type connection to the capsule directly uphole of the respective capsule, then ball members can be left in place in the vent structures of capsule 210", capsule 210'", or both capsule 210" and capsule 210'".

Figure 5:
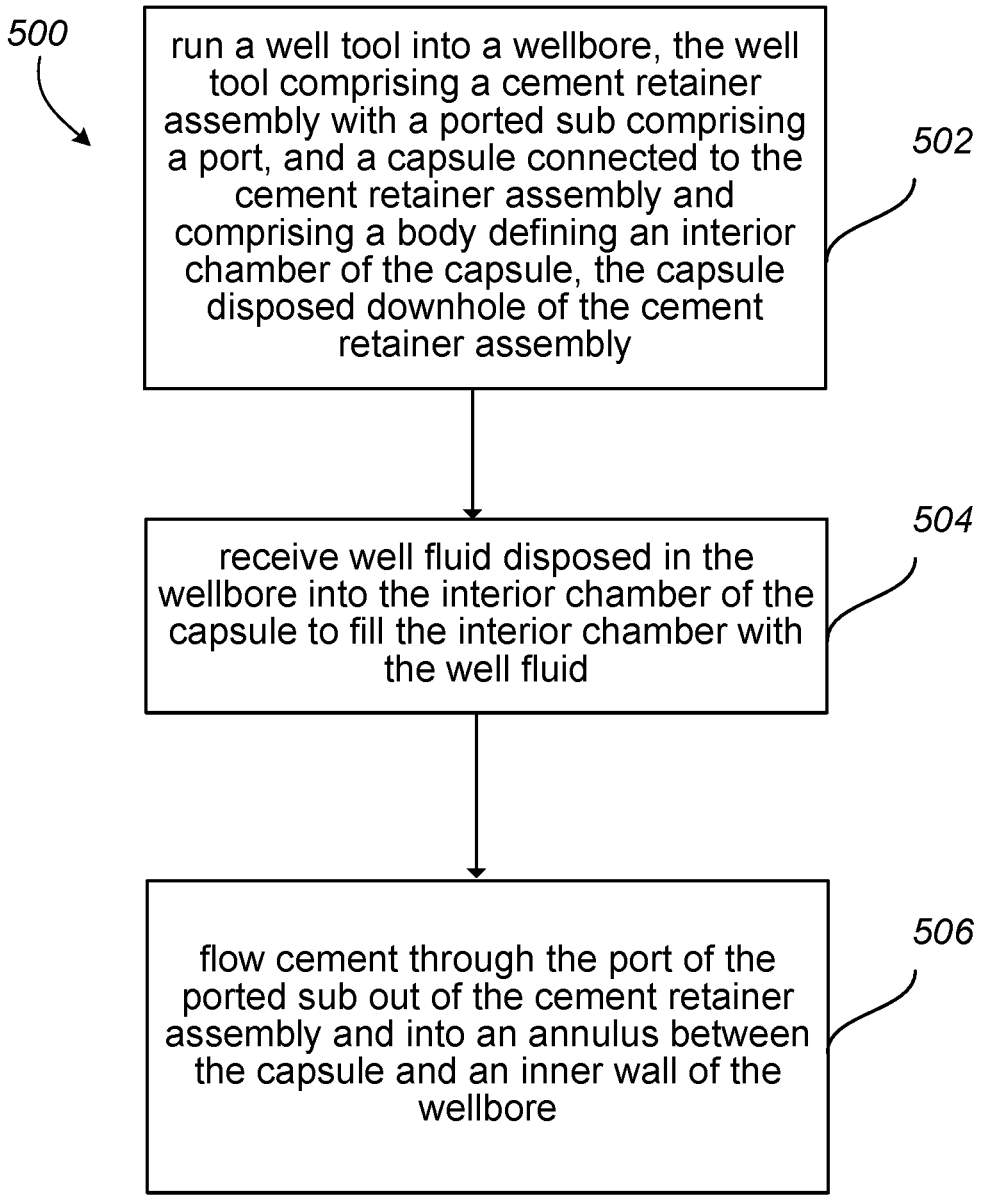
FIG. 5 is a flowchart showing an example process for cementing a portion of a wellbore.

FIG. 5 is a flowchart describing an example method 500 for cementing a portion of a well, for example, performed by the example well tool 114 of FIG. 1-2 or the example well tool 114' of FIG. 4. At 502, a well tool is run into a wellbore, where the well tool includes a cement retainer assembly with a ported sub having a port, and a capsule connected to the cement retainer assembly and including a body defining an interior chamber of the capsule. The capsule is disposed downhole of the cement retainer assembly. At 504, the interior chamber of the capsule receives well fluid disposed in the wellbore to fill the interior chamber with the well fluid. At 506, cement flows through the port of the ported sub out of the cement retainer assembly and into an annulus between the capsule and an inner wall of the wellbore.

A number of implementations have been described. Nevertheless, it will be understood that various modifications may be made without departing from the spirit and scope of the disclosure.

What is claimed is:

1. A well tool for cementing a portion of a well, the well tool comprising:

a cement retainer assembly configured to be disposed within a wellbore, the cement retainer assembly comprising a ported sub, the ported sub comprising a port to flow cement out of the cement retainer assembly and into an annulus of the wellbore; and a capsule connected to the cement retainer assembly and comprising a body defining an interior chamber of the capsule, the interior chamber configured to retain a fluid, the capsule configured to be disposed at a location within the wellbore and downhole of the cement retainer assembly, the capsule comprising a one-way check valve at a first longitudinal end of the capsule and a vent structure at a second longitudinal end of the capsule opposite the first longitudinal end, the one-way check valve configured to allow fluid to enter the interior chamber of the capsule, and the vent structure configured to expel gaseous fluid from within the interior chamber out of the interior chamber of the capsule.

2. The well tool of claim 1, wherein the body of the capsule is comprised of fiberglass.

3. The well tool of claim 1, wherein the capsule comprises centralizers extending radially outwardly from the body, the centralizers to position the capsule proximate to a radial center of the wellbore.

4. The well tool of claim 1, wherein the capsule comprises a first connection structure at a first longitudinal end of the capsule and a second connection structure at a second longitudinal end of the capsule opposite the first longitudinal end.

5. The well tool of claim 4, wherein the first connection structure comprises a threaded pin-type connection or a threaded box-type connection, and the second connection structure comprises a threaded pin-type connection or a threaded box-type connection.

6. The well tool of claim 4, wherein the first connection structure directly couples the capsule to the cement retainer assembly.

7. The well tool of claim 6, wherein the first connection structure directly couples the capsule to the ported sub of the cement retainer assembly.

8. The well tool of claim 6, wherein the second connection structure directly couples to a second capsule configured to be disposed at a location within the wellbore and downhole of the first-mentioned capsule, the second capsule comprising a second body defining a second interior chamber of the second capsule.

9. The well tool of claim 1, wherein the one-way check valve comprises a spring-loaded check valve.

10. The well tool of claim 1, wherein the vent structure comprises a ball member and a ball seat, the ball member having a specific density less than the fluid in the interior chamber.

11. The well tool of claim 1, wherein the vent structure comprises a one-way check valve.

12. The well tool of claim 1, wherein the body is substantially cylindrical, and an outer diameter of the cylindrical body of the capsule is between 65 percent and 80 percent of an inner diameter of an inner wall of the wellbore.

13. The well tool of claim 1, wherein the cement retainer assembly comprises a packer element to seal against an inner wall of the wellbore.

14. The well tool of claim 1, wherein the wellbore is a cased wellbore, and an inner wall of the wellbore comprises an inner wall of a casing.

15. The well tool of claim 1, wherein the ported sub comprises a plurality of ports to flow cement out of the cement retainer assembly, the plurality of ports comprising the port of the ported sub.

16. A method for cementing a portion of a well, the method comprising:

running a well tool into a wellbore, the well tool comprising:

a cement retainer assembly comprising a ported sub, the ported sub comprising a port; and a capsule connected to the cement retainer assembly and comprising a body defining an interior chamber of the capsule, the capsule disposed downhole of the cement retainer assembly;

receiving well fluid disposed in the wellbore into the interior chamber of the capsule to fill the interior chamber with the well fluid, wherein receiving well fluid into the interior chamber of the capsule comprises flowing well fluid through a one-way check valve at a first longitudinal end of the capsule to fill the interior chamber of the capsule with well fluid and expelling gaseous fluid from within the interior chamber out of the interior chamber through a vent structure at a second longitudinal end of the capsule opposite the first longitudinal end; and flowing cement through the port of the ported sub out of the cement retainer assembly and into an annulus between the capsule and an inner wall of the wellbore.

17. The method of claim 16, wherein the cement retainer assembly comprises a packer element to seal against an inner wall of the wellbore, the method comprising:

prior to flowing cement through the port of the ported sub, engaging the inner wall of the wellbore with the packer element to isolate the wellbore downhole of the packer element.

18. The method of claim 17, further comprising positioning the packer element of the cement retainer assembly uphole of a perforation in the inner wall of the wellbore.

19. The method of claim 16, wherein the wellbore is a cased wellbore, the inner wall of the wellbore comprises an inner wall of a casing, and flowing cement into the annulus between the capsule and the inner wall of the wellbore comprises flowing the cement into the annulus between the capsule and the inner wall of the casing.

20. A capsule for a cement squeeze well tool, the capsule comprising:

a body defining an interior chamber configured to retain a fluid;

a connection structure at a first longitudinal end of the body, the connection structure configured to couple to a cement squeeze well tool;

a one-way check valve at a second longitudinal end of the body opposite the first longitudinal end and fluidly connected to the interior chamber, the one-way check valve configured to flow fluid into the interior chamber; and a vent structure at the first longitudinal end of the body and fluidly connected to the interior chamber, the vent structure to expel gaseous fluid out of the interior chamber.

21. The capsule of claim 20, wherein the connection structure comprises a threaded pin-type connection or a threaded box-type connection.

22. The capsule of claim 20, wherein the body is substantially cylindrical.

* * * * *